US005740900A

United States Patent [19]

Cote et al.

[11] Patent Number: 5,740,900

[45] Date of Patent: Apr. 21, 1998

[54] APPARATUS FOR SPLITTING A PRODUCT STREAM

[75] Inventors: Kevin Lauren Cote, Durham; Richard Daniel Curley, Dover, both of N.H.

[73] Assignees: Heidelberger Druckmaschinen AG, Heidelberg, Germany; Heidelberg Harris, Inc., Dover, N.H.

[21] Appl. No.: 504,868

[22] Filed: Jul. 20, 1995

[51] Int. Cl.[6] ..... B65G 47/26

[52] U.S. Cl. ..... 198/436; 271/280

[58] Field of Search ..... 198/434, 436, 198/644, 470.1, 445, 411, 375, 377; 271/184, 204, 205, 280

[56] References Cited

U.S. PATENT DOCUMENTS

| | | | |
|---|---|---|---|
| 3,809,214 | 5/1974 | Reist . | |
| 4,072,228 | 2/1978 | Honegger et al. . | |
| 4,482,139 | 11/1984 | Killer | 198/644 X |
| 4,550,822 | 11/1985 | Meier . | |
| 4,598,902 | 7/1986 | Schneider et al. | 198/436 X |
| 4,607,743 | 8/1986 | Elam . | |
| 5,112,041 | 5/1992 | Honegger | 271/184 X |
| 5,433,430 | 7/1995 | Straessler | 271/280 X |

FOREIGN PATENT DOCUMENTS

| | | | |
|---|---|---|---|
| 0415904 | 3/1991 | European Pat. Off. | 271/280 |

*Primary Examiner*—James R. Bidwell
*Attorney, Agent, or Firm*—Kenyon & Kenyon

[57] ABSTRACT

An apparatus for splitting a product stream includes a conveying belt entering a folder to grip products. The conveying belt comprises first and second product grippers arranged thereon in an endless configuration. The first grippers are selectively rotatable around an axis during movement of the conveying belt to allow for a secondary stream of products to be formed.

19 Claims, 13 Drawing Sheets

APPARATUS FOR SPLITTING A PRODUCT STREAM

FIELD OF THE INVENTION

The present invention relates to an apparatus for splitting a product stream and, more particularly, to an apparatus for splitting a stream of printed products into two or more streams.

BACKGROUND INFORMATION

A stream of printed products may be gripped by a gripper conveyor as commonly known. It is often desirable to split this initial stream of products into two or more separate streams. The current common method of splitting a stream of products, especially printed products, is to drag the initial stream over a vacuum belt traveling slower than the conveying system and to release every other (i.e. second) signature from a gripper conveyor as soon as the respective signature contacts the vacuum belt. However, this often results in relative movement between those signatures delivered onto the vacuum belt and those signatures which remain gripped by the conveying system. Consequently, correct alignment and fixed pitch (the distance between the leading edges of two consecutive signatures in a product stream) of the signatures delivered to the vacuum belt cannot be guaranteed.

A number of patents purport to describe grippers which are used for purposes other than splitting a product stream.

For example, U.S. Pat. No. 4,550,822 purports to disclose an apparatus for transporting flat products, especially printed products. In this configuration each gripping unit comprises a stationary clamping jaw, a pivotable clamping jaw and a plate shaped stop. The pivotable clamping jaw is pivoted against the action of a closing spring by a cam structure or the like. The products are first accelerated and then pushed into the open gripper mouth until they abut the stop so that the printed products are aligned at the region of their leading edges. At their trailing edges the printed products remain under the conveying action of the belt conveyor at least until the gripper units are closed.

U.S. Pat. No. 4,072,228 purports to show an apparatus for evening a stream of printed products. This apparatus comprises a number of revolving entrainment members being in a drag connection with one another. At the region of their conveying action path the entrainment members are guided and at the start of their path driven by a thrust drive and at the end thereof driven by a traction drive. The entrainment members engage the printed products and the thrust and traction drives cause a change in the spacing of the entrainment members and consequently, in the spacing of the products.

U.S. Pat. No. 3,809,214, finally, purports to disclose a turning conveyor for flat structures, especially printed products. This turning conveyor encompasses a plurality of entrainment members which move along with the flat structures and each of which can be brought into engagement with a respective one of the flat structures. The entrainment members are controlled such that at least at the time they are in engagement with a flat structure they carry out a relative movement with regard to the direction of movement of the main conveyor in order to turn the flat structures about an axis being perpendicular to the flat structures.

With the conventional grippers described above, positive control of products, signatures or the like during a split of a primary product stream into secondary product streams is not possible.

SUMMARY OF THE INVENTION

In accordance with the present invention, an apparatus is provided for splitting an initial product stream comprising a single conveying belt having a plurality of grippers traveling along a single conveyor path. At least one of the grippers is capable of rotating a held product from one side of the belt to the other side, so as to create a secondary product stream.

Therefore, the selected products to be removed from the initial product stream to the secondary product stream remain within a substantially horizontal conveying plane as the secondary product stream is created. This prevents damage to the product during movement out of the initial product stream and into the secondary product stream. Furthermore, a second conveying belt is not necessary since the rotatable grippers create the secondary product stream while still being conveyed along a single conveying path. Since the individual grippers can be actuated individually, a whole variety of product splitting patterns can be achieved, thus releasing or inserting selected products, wherever needed.

Moreover, the pitch and alignment of the secondary product stream is assured, because the products of the secondary steam are not dropped onto a vacuum belt, which can lead to distortions of pitch.

In accordance with a first embodiment of the present invention, the products in the initial product stream are conveyed so that they extend substantially on one side of the conveying path. The products can then be selectively rotated to the opposite side of said conveying path and kept substantially within the same horizontally extending plane. This reduces the space requirements of the conveying belt, as compared to prior art systems which required secondary belts.

In accordance with a second embodiment of the present invention, a positive control mechanism may be located on the side of the conveying path to positively grip and receive the products of the secondary stream. After entry of the products into the positive control mechanism, the grippers release the products, and a fixed pitch and correct alignment for the secondary stream are assured because the products are under constant control during rotation and transfer.

In accordance with a third embodiment of the present invention, a similar device also may transfer products remaining in the initial product stream.

In accordance with a fourth embodiment of the present invention, a continuous product conveyance is achieved by providing individual grippers linked to one another throughout the single conveying path. Depending on different requirements, the single conveying path can have a first, a second, a third, a forth or even a fifth group of grippers, the members of each group capable of being actuated individually.

In accordance with a fifth embodiment of the present invention, each gripper includes a gripper head which is rotatable about a rotation axis, and which includes a movable lower portion for gripping and releasing the products. A first actuator is provided for moving the movable lower portion between a release position and a closed position. The first actuator can be, for example, a first actuating pin coupled to a spring mechanism, a hydraulic mechanism, a pneumatic mechanism, or other appropriate device for moving the movable lower portion of the gripper head. A second actuator is provided for rotating the gripper head between a first position (holding products in the initial product stream) and a second position (holding products in the secondary product stream). The second actuator can be, for example, a second actuating pin coupled, for example, to a spring mechanism, a hydraulic mechanism, a pneumatic mechanism, an electrically controlled motor, or other appropriate device for rotating the gripper head.

DETAILED DESCRIPTION OF THE INVENTION

Figure 1:
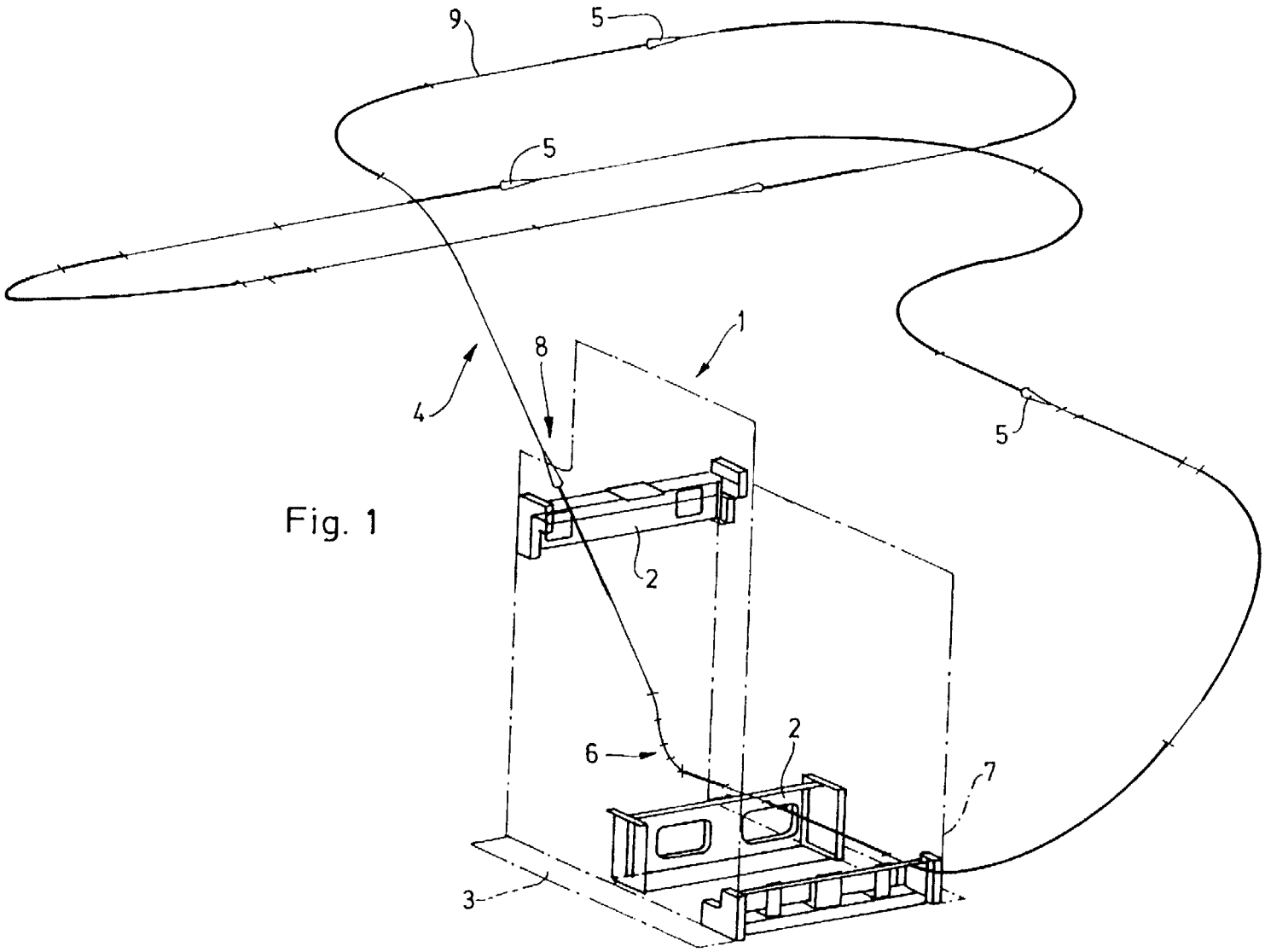
FIG. 1 shows a schematic view of a conveying path for products emerging from a folder.

FIG. 1 shows a conveying path 4 for sheet-like products. A folder 1 has two frames (shown schematically) bridged by traverses 2. The folder 1 is of any well known type which delivers products or signatures. The frame of the folder 1 is raised upon a base 3 on the floor of a print shop. The folder 1 has a product transfer section 6, where products delivered by the folder 1 are seized by a conveying belt 9 with grippers (not shown). This conveying belt 9 passes an exit section 8 of the folder 1 and conveys the gripped products along the conveying path 4 in conveying direction 5.

After the seized products have been delivered at different release stations to bindery facilities or have been inserted into printed material, i.e. newspapers, journals or the like, the conveying belt reenters the folder 1 via entry section 7.

Figure 2A:
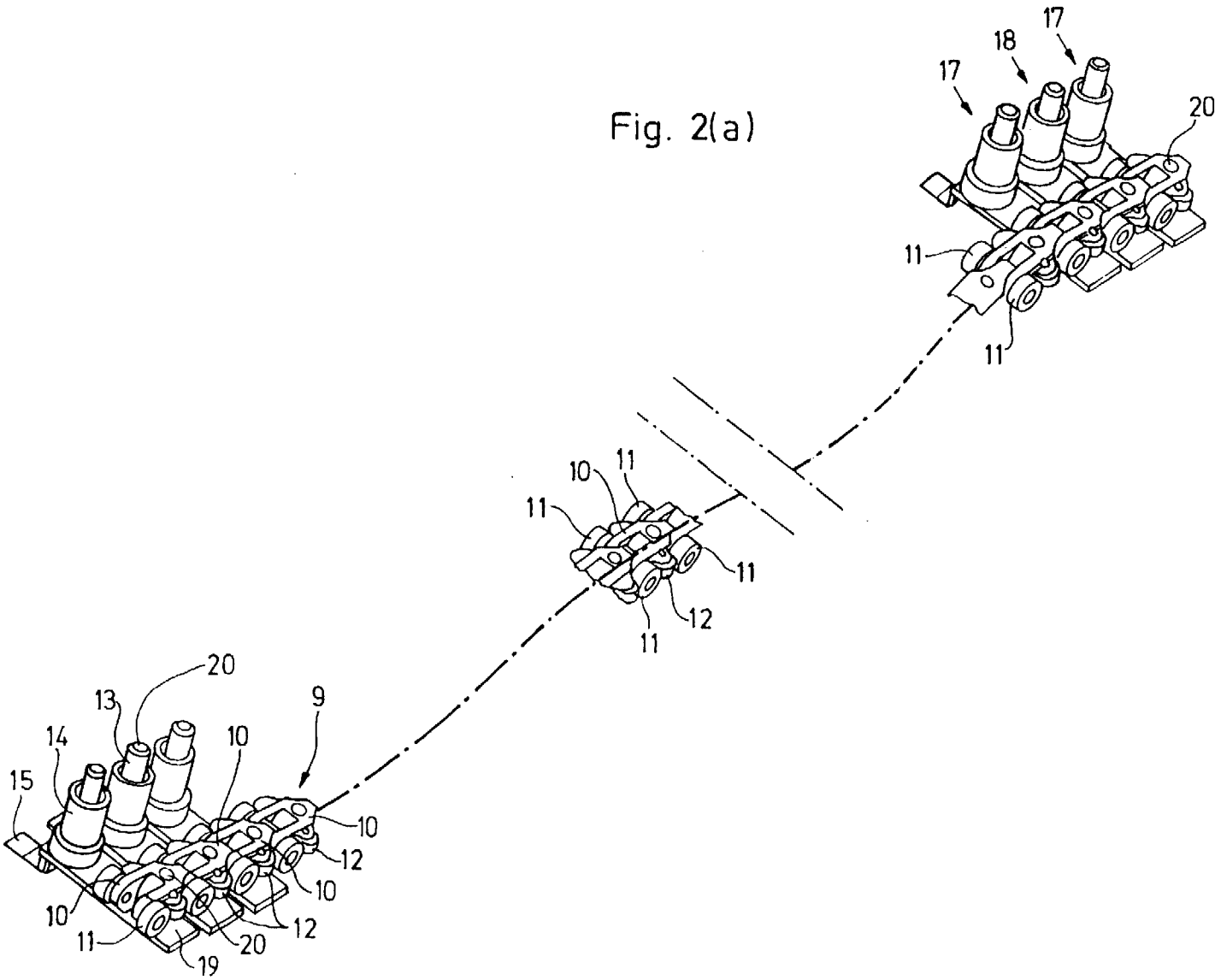
FIGS. 2(*a–c*) shows a plurality of grippers traveling along the conveying path.
Figure 2B:
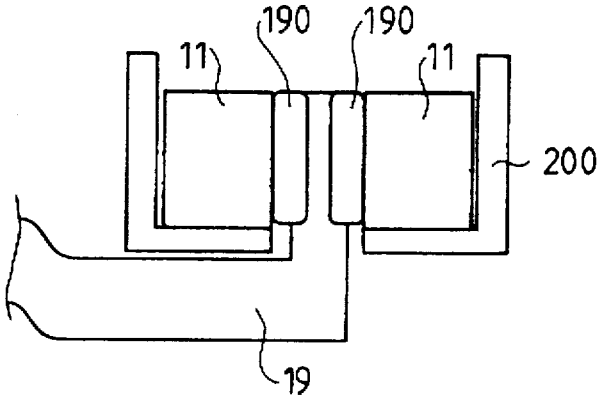
Figure 2C:
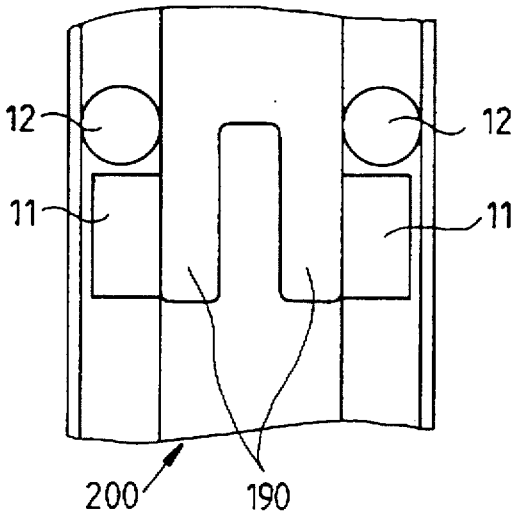
Figure 3A:
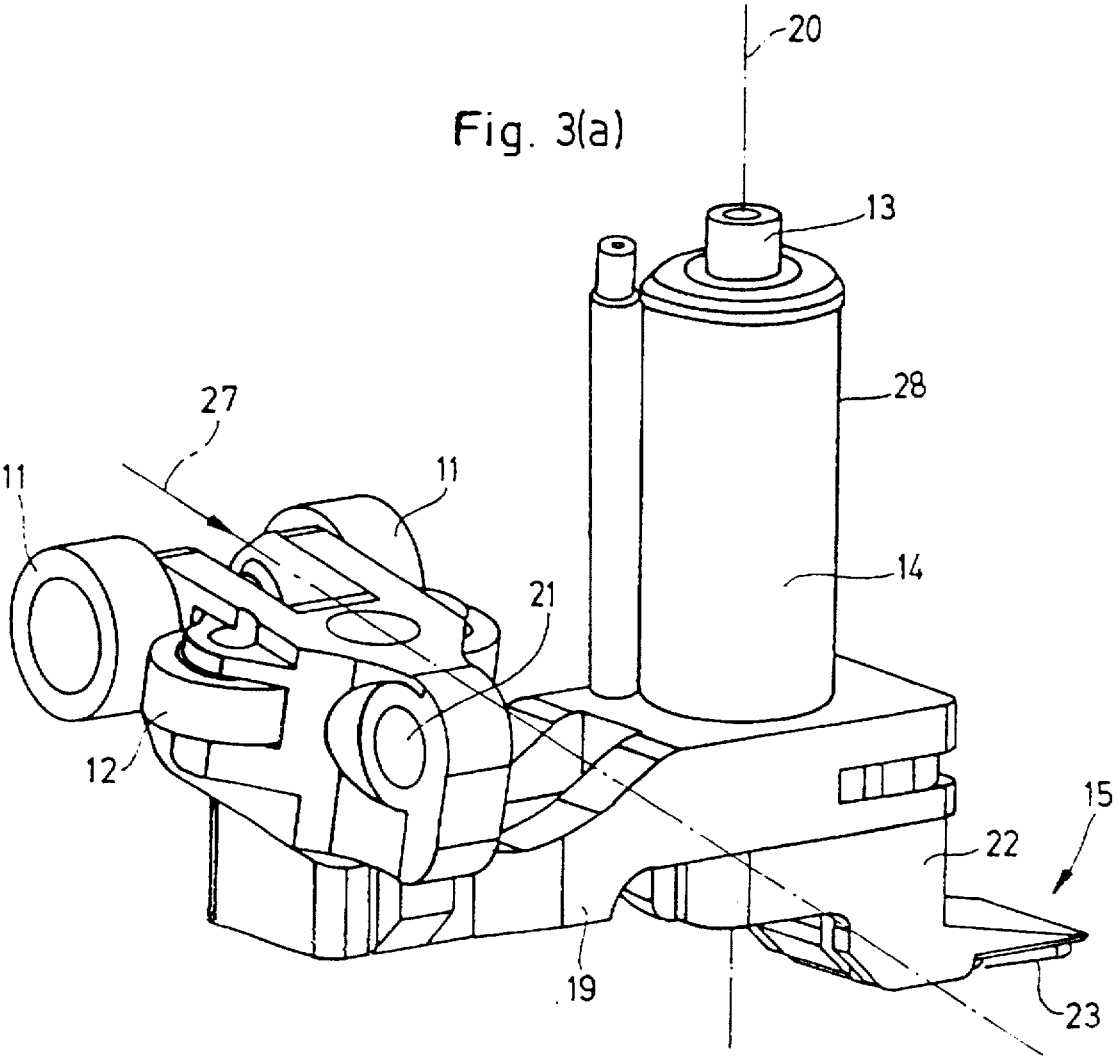
FIGS. 3(*a–d*) shows one of the grippers in greater detail.
Figure 3B:
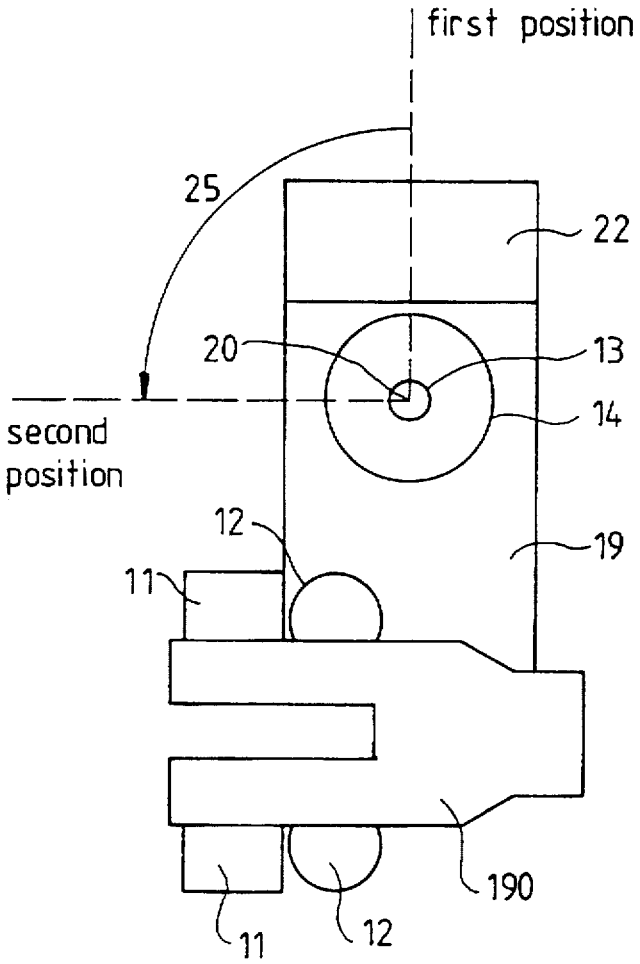
Figure 3C:
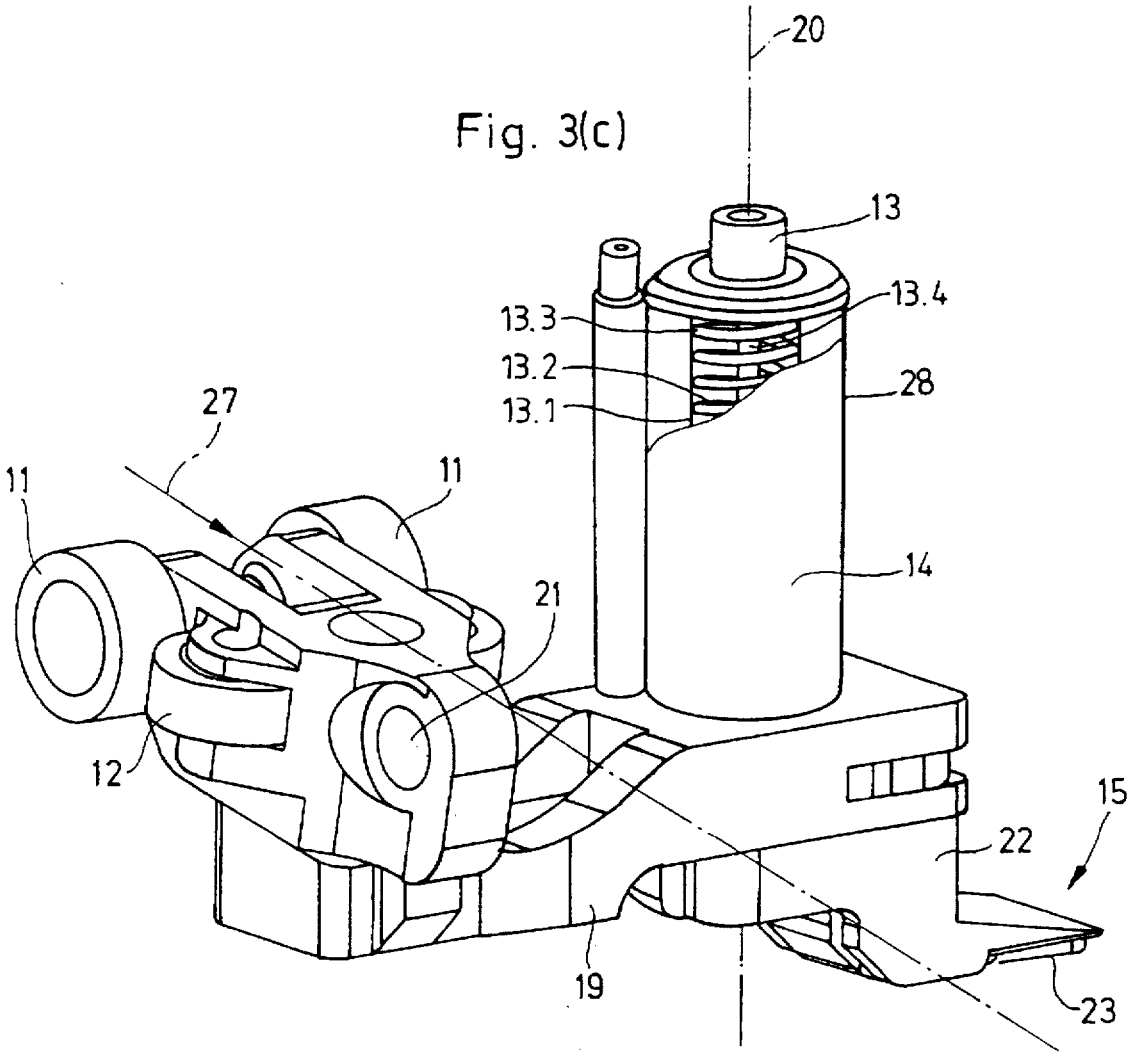
Figure 3D:
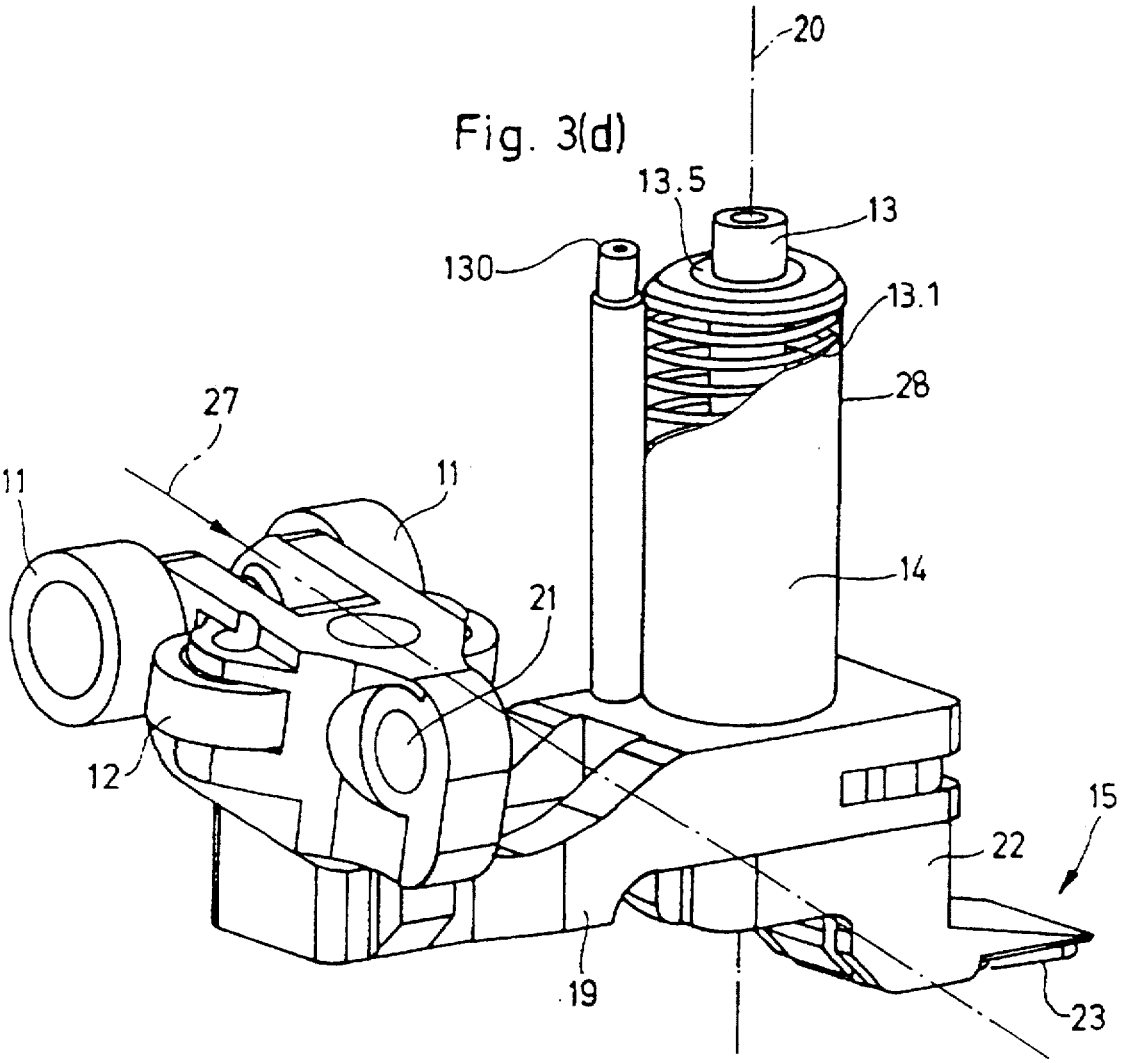

FIGS. 2(*a–c*) show the conveying belt 9 in greater detail. A single conveying belt 9 comprises grippers 10, which are linked to one another. The grippers 10 have guide rollers 11, 12 mounted on a U-shaped housing 190 to keep the conveying belt 9 following the path of a stationary conveying track 200, which, for example can be constructed in an L-shaped configuration. Referring to FIGS. 2(*b,c*), the guide rollers 11 are in rolling engagement with the horizontal portion of the stationary conveying track 200, while the guide rollers 12 are in rolling engagement with the vertical portion of the stationary conveying track 200. Each of the grippers 10 is equipped with a first actuating pin 13, which is pretensioned by a spring 13.3(not shown). The actuating pin 13 activates a moveable portion of a product gripper head 15, for selectively gripping and releasing a product which is held by the gripper 10. As shown schematically, each of the grippers 10 includes a support 19, extending perpendicularly with respect to the conveying direction. On the support 19, the gripper head 15, the spring 13.3, and the actuating pin 13 are mounted, as shown in detail in FIGS. 3(*a–d*).

In the configuration shown in FIG. 2, the conveying belt 9 comprises a first set 17 of grippers 10, hereinafter called A-grippers and a second set 18 of grippers 10 hereinafter called B-grippers. It is readily apparent that a third or forth or even a fifth species of grippers can easily be defined. To explain the principle it is, however, sufficient to define an A-gripper set 17 and a B-gripper set 18.

As shown in FIG. 2, the grippers 10 have a rotation axis 20, about which the gripper head 15 is pivotable. FIGS. 3(*a–d*) show one of the grippers 10 in greater detail. The gripper 10 is being transported in conveying direction 27 and is guided via guide rollers 11, 12 along the conveying track 200 in a conventional fashion. The rotation axis 20 extends perpendicular relative to the conveying direction 27, thus allowing the gripper head 15 to rotate. The rotational movement of said gripper head 15 extends approximately 90 degrees through the given angle 25 as shown in FIG. 3(*b*).

FIG. 3(*c*) shows a cross-section through a portion of the gripper 10. The first actuating pin 13 is linked with a moveable portion 23 of a product gripper head 15 via a rod 13.4. A stationary portion 22 of said product gripper head 15 is mounted to the support 19. By applying pressure to the first actuating pin 13, the moveable portion 23 of the gripper 10 is moved downward releasing a product held between the stationary portion 22 and the moveable portion 23. Within a housing 13.1, a spring 13.3 is pretensioned between an upper support 13.5 and a lower support 13.2, the upper support 13.5 mounted to the rod 13.4. When pressure is applied to the actuating pin 13, and the rod 13.4 moves the movable portion 23 downward as described above, the spring 13.3 compresses. Once pressure is removed from the rod 13.4, the compressed spring expands, moving the movable portion upward towards the stationary portion 22.

Referring to FIG. 3(*d*), on the support 19, a pretensioning device such as a spring 14 is mounted for facilitating the rotational movement of the gripper head 15. A second actuating pin 130 is provided for actuating rotational movement of the gripper head 15 about the axis 20. Just prior to the entry section 7 (see FIG. 1), a cocking mechanism (e.g., a post appropriately mounted in the path of the gripper head 15) engages the gripper head 15 and rotates it into a first (cocked) position as shown in FIG. 3(*b*). In the first position, the spring 14 is held in tension by an actuation device (e.g. a tab holding one end of the spring 14). When the second actuating pin 130 is subsequently pressed, it causes the actuating mechanism to release the spring 14 from tension and the gripper head gradually rotates counterclockwise along the angle 25 into the second (rotated) position as shown in FIG. 3(*b*). As described in more detail below, triggering of the second actuating pin 130, as well triggering of the first actuating pin 13, can be accomplished by actuating mechanisms 340 (not shown) in a variety of ways.

While the rotation of the gripper head 15 has been described above with respect to a spring actuated mechanism, it should be clear that other rotation mechanisms are also acceptable. For example, rotation of the gripper head 15 could be accomplished with conventional hydraulic or pneumatic mechanisms. Alternatively, an electrically controlled motor could be used. Moreover, it should be clear that the gripper head 15 can be returned to the first position under the control of a pneumatic, hydraulic, or electrically controlled mechanism. Rotation from the second position to the first position could then be triggered, for example, by providing an additional actuating pin, or by toggling the actuating pin 130.

Similarly, while the actuating pin 13 is illustrated as opening the gripper 15 by means of a spring mechanism, it should be clear that a hydraulic or pneumatic mechanism, or any other suitable device, could also be used.

Figure 4:
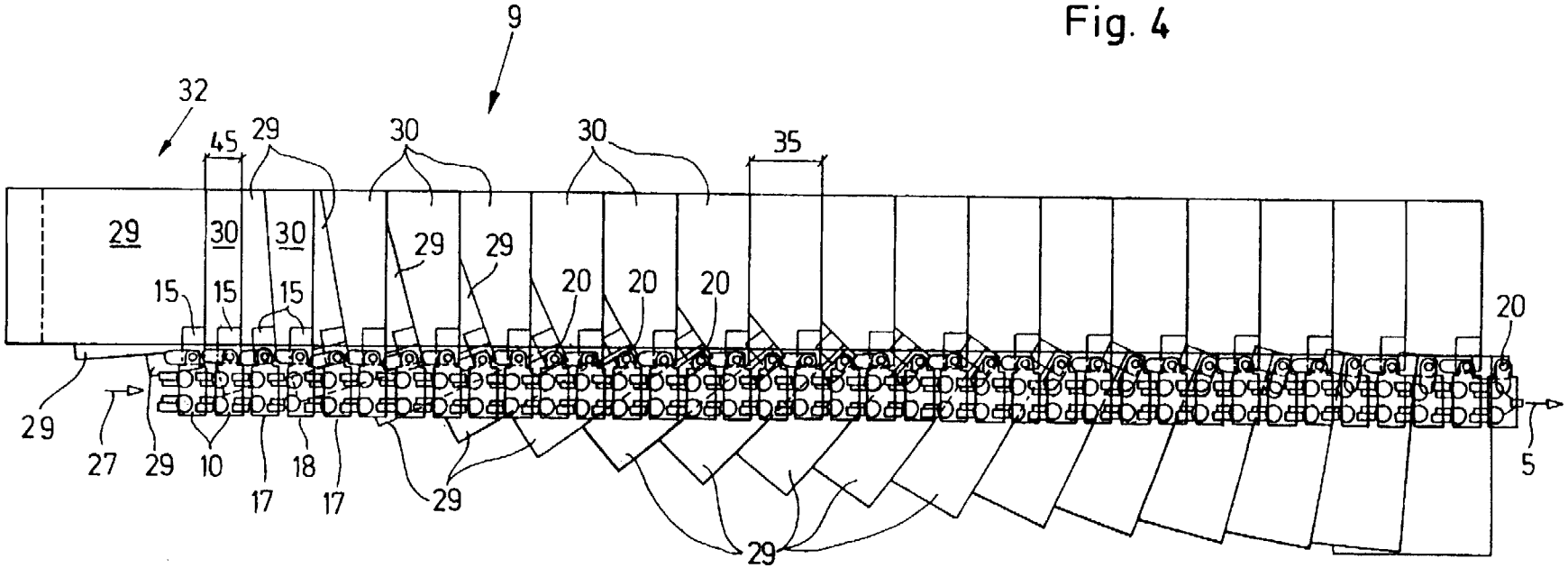
FIG. 4 is a view of a shingled product stream from which products are selectively taken.

FIG. 4 is a view of a shingled product stream from which products are selectively taken. The conveying belt 9 transports a stream of shingled products 32, including products 29, 30 which move in conveying direction 27 along the conveying path 5. Each of the products 29, 30 is gripped by the gripper head 15.

As described above, the grippers 10 each have a rotation axis 20 allowing the gripper head 15 to rotate. For reasons of clarity, there are shown in FIG. 4 a set 17 of A-grippers, each gripping a product 29 and a set 18 of B-grippers each gripping a product 30. The B-grippers 18 substantially remain in their position relative to the conveying direction 27, thus keeping the products 30 in a fixed pitch on one side of the conveying track. The products 29, each fixed by an A-gripper 17, however, are rotated around the axis 20 thus leaving the shingled formation of the product stream. After a rotation of approximately 90 degrees, the former leading edge of the products 29 becomes a side edge and the side edge consequently the new leading edge of the products 29, which are now conveyed on the opposite side of the conveying track.

Thus, a split of a product stream into at least two different product streams, each having a fixed pitch, can be achieved by selectively rotating a first group of grippers 17, i.e. A-grippers, around the axis 20. Referring to FIG. 4, prior to selective rotation of the A-grippers, the single product stream has a pitch 45 between products 29,30. After selective rotation of the A-grippers, the stream of products 30, as well as the stream of products 29, each have a pitch 35 between products.

Figure 5:
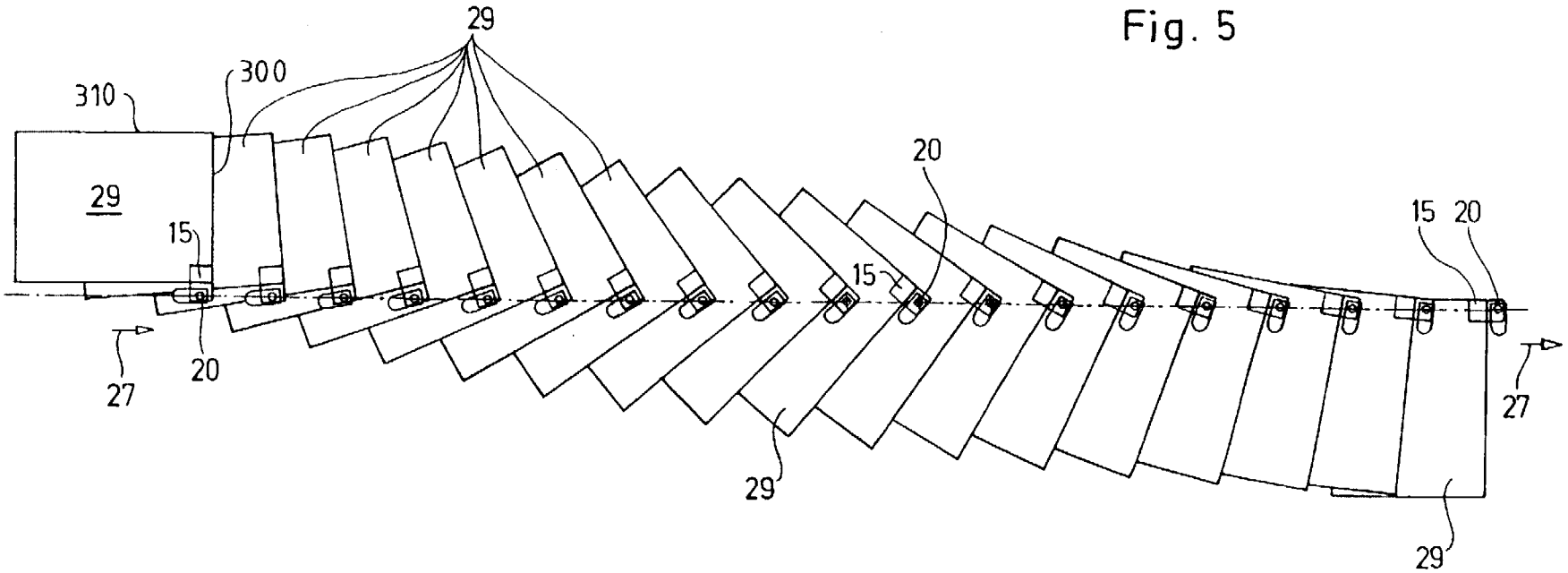
FIG. 5 shows the movement of those products selectively rotated out of their original conveying position.

FIG. 5 shows only those products of FIG. 4 which are selectively rotated out of the original conveying position, so that the 90 degree movement may be more clearly seen. The dashed line—extending in conveying direction 27—indicates the centers of said rotation axes 20, substantially being conveyed parallel to the conveying path 4 in a defined position. The gradually performed rotation of a selected product 29 can be seen. Upon completion of the rotational movement, the selected products 29 have accordingly changed their conveying position, and the former leading edge 300 has become a side edge, and the former side edge 310 has become a leading edge.

Figure 6:
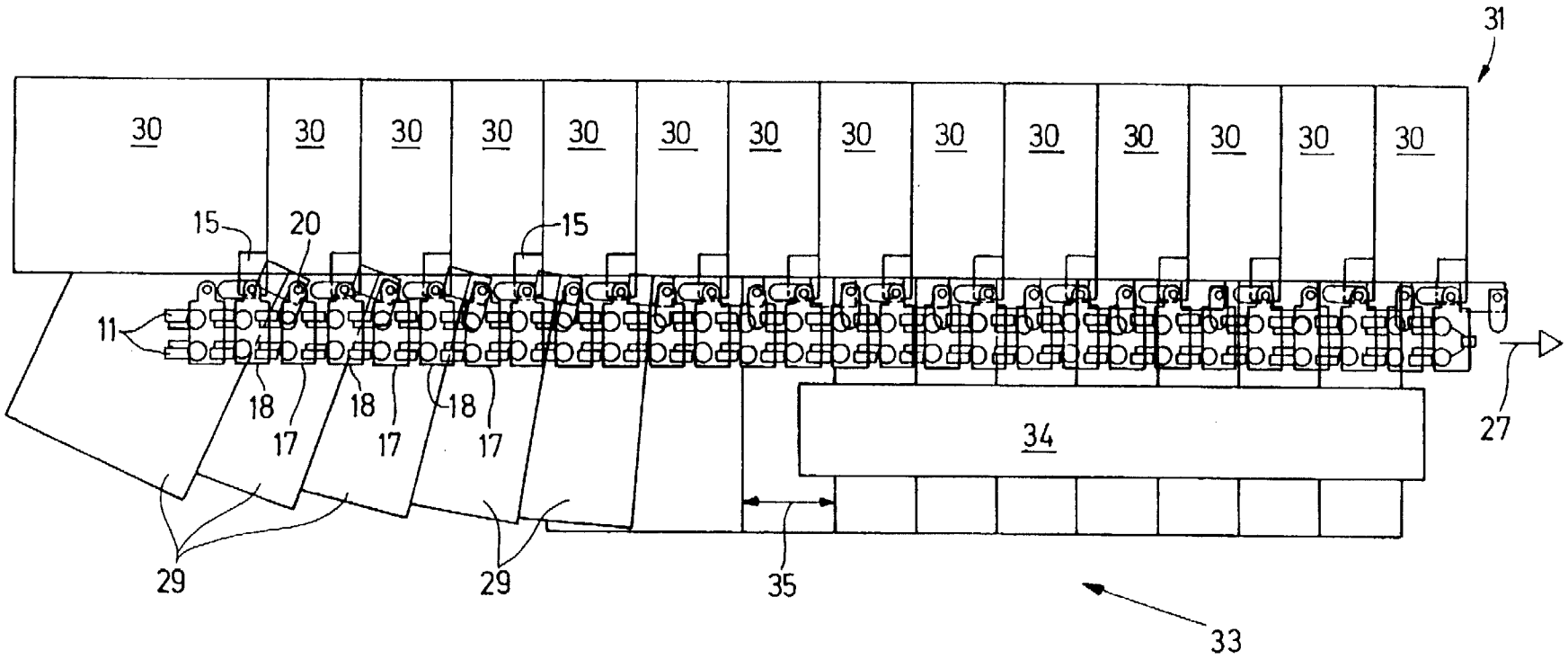
FIG. 6 is a view of a positive control mechanism for generating a fixed pitch in a released secondary product stream.

FIG. 6 shows a positive control mechanism 34 for maintaining a fixed pitch and proper product alignment after release of the products 29 from the grippers 10.

After selective rotation, products 29, 30 are being conveyed on respective sides of the conveying path at a fixed pitch 35. After the selective rotational movement is completed, control of the rotated products 29 is transferred to a positive control mechanism 34. The positive control mechanism 34 may, for example include a set of belts which are located on the side of the conveying track the rotated products 29 are moved to. Once the products 29 enter the positive control mechanism 34, the products are released by the grippers 17 at a fixed pitch 35.

Thus, an initial stream of products is split into two separate product streams having a defined pitch 35, and release of products 29, 30 at different release stations is accomplished. Since the first and the second sets of grippers 17, 18 are coupled to each other in an endless configuration, a continuous delivery of products 29, 30 on both sides of the conveying path can be maintained.

Figure 7:
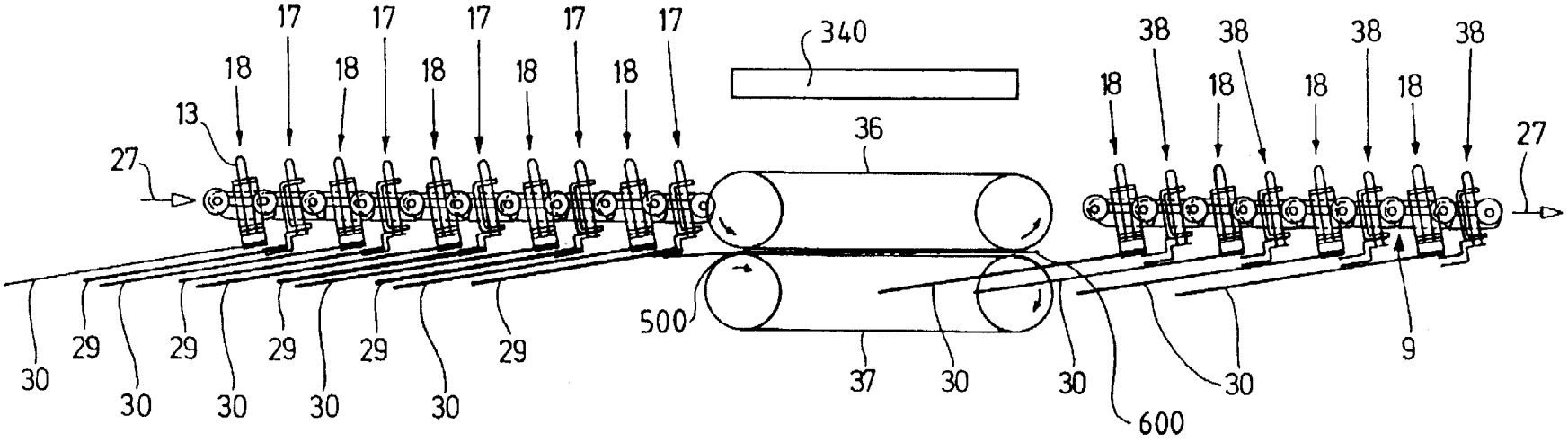
FIG. 7 shows the positive control mechanism in greater detail, as well as the plurality of grippers before and after product release.

In FIG. 7, a side view of the conveying belt 9 is shown, including the positive control mechanism 34 to which the rotated products 29 are released. The positive control mechanism 34 includes a pair of rotating belts 36, 37 driven by cylinders to form an entrance nip 500 and an exit nip 600. As described above, the conveying belt 9 includes A-grippers 17 fixing products 29, and B-grippers 18 fixing products 30, the A-grippers 17 being selected for rotation, thereby splitting the product stream into at least two different streams. Referring to FIG. 7, the A-grippers 17 with products 29 have been rotated 90°, the grippers 17 being shown in their side view. The B-grippers 18, however, substantially remain in their original position holding the products 30, and, therefore, only the back portion of the B-grippers 18 are shown.

As described above, the selected products 29 are released from the respective A-grippers 17 after they are engaged by the upper and lower belts 36, 37. On the other hand, the products 30 remain substantially in their original position and are further conveyed in conveying direction 27. Release of the selected products 29 from the A-grippers 17 is accomplished by pressing the first actuating pin 13 with an actuating mechanism 340. Once released, the A-grippers 17 have now become empty grippers 38 to be conveyed along the conveying path 4. By means of said upper and lower belts 36, 37, the products 29 are inserted into journals or the like, or are delivered to bindery or other finishing devices.

Further along on the conveyer path 4, the remaining products 30 may be retrieved from a second set of conveyer belts and another actuating mechanism 340 and then sent to separate finishing devices, so that the printed product stream is split effectively without loss of a fixed pitch.

Figure 8:
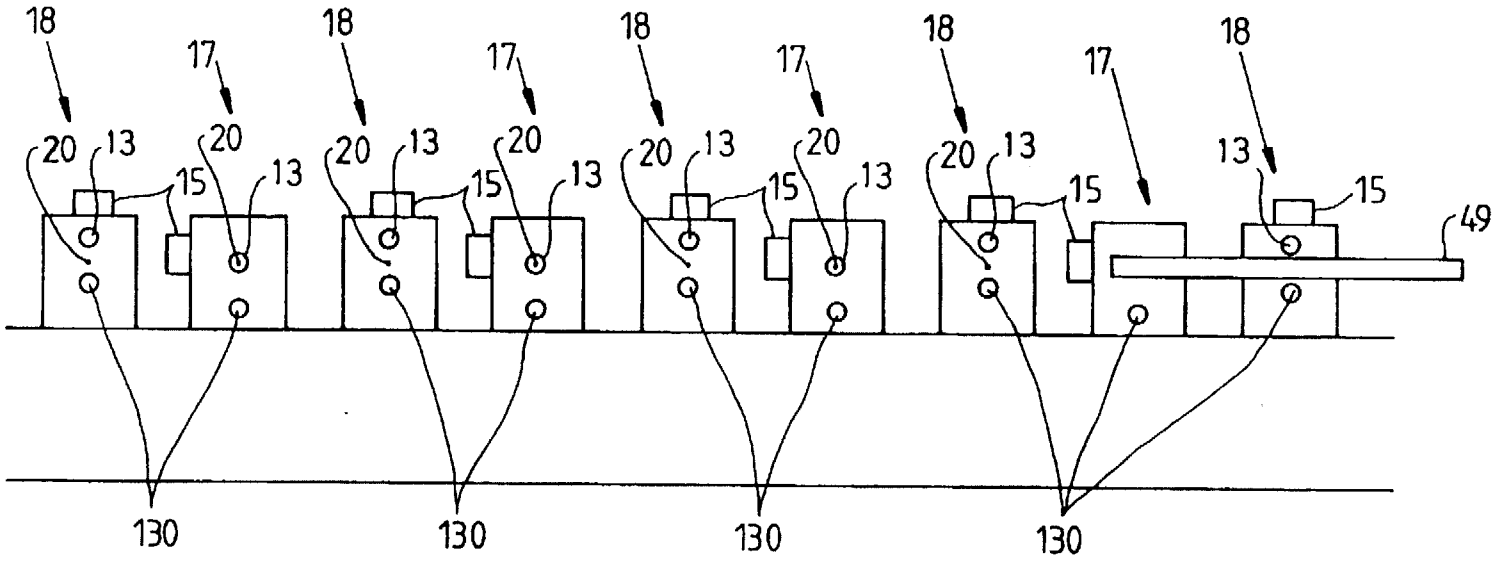
FIG. 8 shows a top view of the conveying belt and a first embodiment of an actuating mechanism for releasing products from the grippers of the conveying belt.

Actuation of the actuating pins 13, 130 by the actuating mechanisms 340 can be accomplished in a variety of ways. For example, referring to FIG. 8, the position of the actuating pin 13 on the A-grippers 17 can be provided on a different plane than the actuating pin 13 on the B-grippers 18. The actuating mechanisms 340 can be formed as an actuating bar 49 positioned in the appropriate plane for releasing products from either the A-grippers 17 or the B-grippers 18. Referring to FIG. 8, when the A-grippers 17 reach the actuating bar 49, their respective actuating pins 13 contact the actuating bar 49, thereby causing a downward movement of the moveable portion 23 of the gripper head 15, and a release of the products 29. In contrast, since the actuating pins 13 of the B-grippers are not in the same plane as the actuating bar 49, the products 30 are not released. In order to release the products 30, an actuating bar is placed in the appropriate plane at the desired location along the conveying path 4. Triggering of the actuating pins 130 can be accomplished in the same manner.

Figure 9:
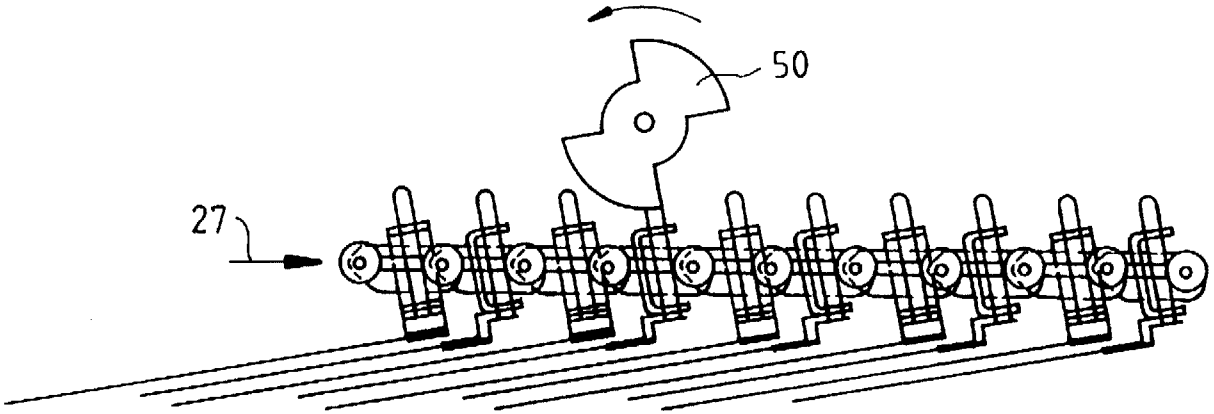
FIG. 9 shows a side view of the conveying belt and a second embodiment of the actuating mechanism for releasing products from the grippers of the conveying belt.

Release or rotation of the products 29, 30 can also be accomplished in other ways. For example, if both the A-grippers 17 and B-grippers 18 are identical, a notched wheel 50 can be placed over the conveyor path 5 as shown in FIG. 9. By properly initializing the wheel, and synchronizing the rotation of the wheel to the conveying speed of the conveyer belt 9, rotation or release of either the A-grippers 17 or the B-grippers 18 can be accomplished.

Finally, as described in U.S. Pat. No. 5,501,443, entitled "Device For The Release Of Folded Products" issued Mar. 26, 1996, the specification of which is hereby incorporated by reference, a release module can be used to release or rotate the desired products.

What is claimed is:

1. An apparatus for splitting a product stream comprising:

a conveying belt including at least a plurality of first grippers and a plurality of second grippers, each of the first and second grippers gripping a respective product and conveying the products as a first product stream in a conveying direction;

one or more of the second grippers being rotatable about an axis and rotating its respective product so as to form a separate second product stream in the conveying direction.

2. The apparatus as recited in claim 1 wherein the conveying belt conveys the first product stream on a first side of the conveying belt prior to rotation of the second grippers.

3. The apparatus as recited in claim 2 wherein the second product stream is located on an opposite side of the conveying belt relative to the first product stream.

4. The apparatus as recited in claim 1 wherein every other gripper on the conveying belt is a second gripper.

5. The apparatus as recited in claim 1 wherein the one or more of the plurality of second grippers has a gripper head rotatably mounted thereon.

6. The apparatus as recited in claim 1 wherein every other product of the first product stream is selectively moved to the second product stream by a respective second gripper.

7. The apparatus according to claim 1, wherein each of the plurality of second grippers rotates its respective product to form the separate second product stream in the conveying direction.

8. An apparatus for splitting a product stream comprising:

a conveying belt including at least a plurality of first grippers and a plurality of second grippers, each of the first and second grippers gripping a respective product and conveying the products as a first product stream in a conveying direction;

one or more of the second grippers having a gripper head rotatably mounted thereon and rotating its respective product so as to form a separate second product stream in the conveying direction, the gripper head rotating between a first position and a second position, the one or more of the second grippers having an actuating pin mounted thereon, a spring linked to the actuating pin and the gripper head, the spring held in tension in the first position, the spring released from tension upon triggering of the actuating pin, thereby causing rotation of the gripper head into the second position.

9. An apparatus for splitting a product stream comprising:

a conveying belt including at least a plurality of first grippers and a plurality of second grippers, each of the first and second grippers gripping a respective product and conveying the products as a first product stream in a conveying direction;

one or more of the second grippers having a gripper head rotatably mounted thereon; and a support, the gripper head rotationally mounted on the support, the gripper head rotating its respective product so as to form a separate second product stream in the conveying direction.

10. The apparatus as recited in claim 9 wherein the gripper head is disposed parallel to a longitudinal axis of the support.

11. The apparatus as recited in claim 10 wherein the gripper head has a stationary portion affixed to the support.

12. An apparatus for splitting a product stream comprising:

a conveying belt including at least a plurality of first grippers and a plurality of second grippers, each of the first and second grippers gripping a respective product and conveying the products as a first product stream in a conveying direction;

one or more of the second grippers rotating its respective product so as to form a separate second product stream in the conveying direction wherein at least one of the plurality of first grippers and the plurality of second grippers has a product gripper head having a moveable portion for gripping a product and an actuating pin, the moveable portion being linked to the actuating pin.

13. An apparatus for splitting a product stream comprising:

a conveying belt including at least a plurality of first grippers and a plurality of second grippers, each of the first and second grippers gripping a respective product and conveying the products as a first product stream in a conveying direction;

one or more of the second grippers rotating its respective product so as to form a separate second product stream in the conveying direction; and a positive control mechanism, the positive control mechanism gripping the products from the first product stream, each of the first grippers releasing the product after the product has been gripped by the positive control mechanism.

14. The apparatus according to claim 13, wherein the positive control mechanism includes at least one conveyer belt.

15. The apparatus according to claim 13, wherein the positive control mechanism includes a first conveyer belt rotating about a first cylinder and a second conveyer belt rotating about a second cylinder, the first and second cylinders forming a nip, the first grippers conveying the products into the nip before releasing the products.

16. The apparatus according to claim 13, wherein the positive control mechanism includes at least one conveyer belt.

17. The apparatus according to claim 13, wherein the positive control mechanism includes a first conveyer belt rotating about a first cylinder and a second conveyer belt rotating about a second cylinder, the first and second cylinders forming a nip, the second grippers conveying the products into the nip before releasing the products.

18. An apparatus for splitting a product stream comprising:

a conveying belt including at least a plurality of first grippers and a plurality of second grippers, the first and second grippers being linked to one another to form the conveying belt, each of the first and second grippers gripping a respective product and conveying the products as a first product stream in a conveying direction;

one or more of the second grippers rotating its respective product so as to form a separate second product stream in the conveying direction.

19. An apparatus for splitting a product stream comprising:

a conveying belt including at least a plurality of first grippers and a plurality of second grippers, each of the first and second grippers gripping a respective product and conveying the products as a first product stream in a conveying direction;

each of the second grippers rotating its respective product so as to form a separate second product stream in the conveying direction; and a positive control mechanism, the positive control mechanism gripping the products from the second product stream, the second grippers releasing the product after the product has been gripped by the positive control mechanism.

* * * * *